US007240996B2

(12) United States Patent
Kobayashi et al.

(10) Patent No.: US 7,240,996 B2
(45) Date of Patent: Jul. 10, 2007

(54) LIQUID DELIVERING APPARATUS

(75) Inventors: Kazuo Kobayashi, Kakamigahara (JP); Masatomo Kojima, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 162 days.

(21) Appl. No.: 10/889,137

(22) Filed: Jul. 13, 2004

(65) Prior Publication Data

US 2005/0012789 A1 Jan. 20, 2005

(30) Foreign Application Priority Data

Jul. 15, 2003 (JP) ..... 2003-197329

(51) Int. Cl.
*B41J 2/045* (2006.01)

(52) U.S. Cl. ..... 347/68; 347/69

(58) Field of Classification Search ..... 347/68, 347/70–72, 69; 29/25.35
See application file for complete search history.

(56) References Cited

U.S. PATENT DOCUMENTS 6,174,051 B1 * 1/2001 Sakaida ..... 347/72

FOREIGN PATENT DOCUMENTS

JP A-10-109412 4/1998
JP A-11-34341 2/1999

* cited by examiner

*Primary Examiner*—An H. Do
(74) *Attorney, Agent, or Firm*—Oliff & Berridge, PLC

(57) ABSTRACT

A liquid delivering apparatus including a piezoelectric sheet which is opposed to liquid chambers and is polarized in a direction of thickness thereof; a restrictor sheet which is opposed to the liquid chambers, restricts a deformation of the piezoelectric sheet, and functions as a first electrode; and second electrodes which are opposed, via active portions of the piezoelectric sheet, to restrictive portions of the restrictor sheet, respectively, and are opposed to the liquid chambers, respectively. When an arbitrary one of the active portions of the piezoelectric sheet is deformed by an electric field which is generated in a direction substantially parallel to the direction of polarization of the piezoelectric sheet, the arbitrary one of the active portions of the piezoelectric sheet and a corresponding one of the restrictive portions of the restrictor sheet are curved in a direction to increase a volume of a corresponding one of the liquid chambers.

30 Claims, 7 Drawing Sheets

LIQUID DELIVERING APPARATUS

The present application is based on Japanese Patent Application No. 2003-197329 filed on Jul. 15, 2003, the contents of which are incorporated herein by reference.

BACKGROUND OF THE INVENTION

1. Field of the Invention

The present invention relates to a liquid delivering apparatus and, in particular, to such a liquid delivering apparatus employing a sheet-stacked body in which a piezoelectric sheet and a restrictor sheet are stacked on each other and which is deformed or curved in a direction to increase a volume of a liquid chamber which accommodates a liquid.

2. Related Art Statement

There has conventionally been known a liquid delivering apparatus which delivers a liquid from a liquid chamber to an external location, by deforming a piezoelectric element and thereby applying a pressure to the liquid in the liquid chamber to which the piezoelectric element is opposed. An example of the liquid delivering apparatus is an ink jet recording head disclosed by, e.g., Japanese Patent Application Publication No. 11-34341. The ink jet recording head includes a cavity sheet having a plurality of groove-like ink chambers that communicate with a plurality of ink ejection nozzles, respectively; and a piezoelectric element which is stacked on the cavity sheet so as to close the ink chambers. The piezoelectric element includes an elastic sheet located on the side of the ink chambers; and a piezoelectric sheet stacked on the elastic sheet. The piezoelectric sheet is sandwiched by a single common electrode located on the side of the elastic sheet, and a plurality of individual electrodes located on the opposite side (i.e., on an upper surface of the piezoelectric sheet) and corresponding to the ink chambers. An electric voltage is applied to the common electrode and an arbitrary one of the individual electrodes.

In the ink jet recording head constructed as described above, when a drive device applies a positive voltage to a desired one of the individual electrodes and a negative voltage to the common electrode, a portion of the piezoelectric sheet that corresponds to the one individual electrode is shrunk in directions parallel to opposite major surfaces of the piezoelectric sheet, and a portion of the elastic sheet that corresponds to the one individual electrode restricts the shrinkage of the piezoelectric sheet. Consequently the respective portions of the piezoelectric sheet and the elastic sheet are so deformed or curved as to project into a corresponding one of the ink chambers. This deformation applies a pressure to the ink accommodated in the one ink chamber, and accordingly a droplet of ink is ejected from a corresponding one of the ink ejection nozzles in a so-called "fill-after-fire" manner.

SUMMARY OF THE INVENTION

However, the piezoelectric element of the above-indicated ink jet recording head needs to employ, in addition to the elastic sheet to restrict the deformation of the piezoelectric sheet, the common electrode as one of two electrodes needed to apply an electric voltage to the piezoelectric sheet, such that the common electrode is located between the elastic sheet and the piezoelectric sheet.

In addition, in the case where the ink is ejected in the above-explained "fill-after-fire" manner, a considerably high voltage is needed to apply an appropriate pressure to the liquid, and it costs higher to obtain an apparatus suitable for use of the high voltage.

It is therefore an object of the present invention to provide a liquid delivering apparatus which is free of at least one of the above-indicated problems. It is another object of the present invention to provide a liquid delivering apparatus which employs simple electrodes to apply an electric voltage to a piezoelectric sheet, and efficiently applies a pressure to a liquid.

According to the present invention, there is provided a liquid delivering apparatus, comprising a piezoelectric sheet which is opposed to a plurality of liquid chambers for accommodating a liquid and which is polarized in a direction of thickness thereof a restrictor sheet which is opposed to the liquid chambers, which restricts a deformation of the piezoelectric sheet, and which functions as a first electrode; and a plurality of second electrodes which are opposed, via a plurality of active portions of the piezoelectric sheet, to a plurality of restrictive portions of the restrictor sheet, respectively, and are opposed to the liquid chambers, respectively. When an arbitrary one of the active portions of the piezoelectric sheet is deformed by an electric field which is generated in a direction substantially parallel to the direction of polarization of the piezoelectric sheet, the arbitrary one of the active portions of the piezoelectric sheet and a corresponding one of the restrictive portions of the restrictor sheet are curved in a direction to increase a volume of a corresponding one of the liquid chambers.

In the liquid delivering apparatus in accordance with the present invention, when an electric voltage is applied to the restrictor sheet provided on one side of the piezoelectric sheet, and each of the second electrodes that is provided on the other side of the piezoelectric sheet and cooperates with a corresponding one of the restrictive portions of the restrictor sheet to sandwich a corresponding one of the active portions of the piezoelectric sheet, an electric field is produced in a direction substantially parallel to the direction of polarization of the piezoelectric sheet. Owing to this electric field, the one active portion of the piezoelectric sheet is deformed, by piezoelectric effect, in a direction substantially parallel or perpendicular, to the direction of polarization thereof, and the one restrictive portion of the restrictor sheet restricts the deformation of the one active portion. Consequently, the respective portions of the piezoelectric sheet and the restrictor sheet are deformed or curved in a direction away from the liquid chamber, so that the volume of the liquid chamber is increased and the pressure of the liquid accommodated in the liquid chamber is decreased. When the application of the electric voltage is stopped, the respective portions of the piezoelectric sheet and the restrictor sheet return to their initial shapes, and the pressure of the liquid in the chamber is increased. Thus, some amount of the liquid is delivered from the liquid chamber to an outside location. Although the two electrodes to apply the electric voltage to the piezoelectric sheet, and the restrictor sheet to restrict the deformation of the piezoelectric sheet are needed, the restrictor sheet also functions as one of the two electrodes. Therefore, a step of producing the one electrode can be omitted, and accordingly the present apparatus can be produced at reduced cost. In addition, the liquid in the liquid chamber can be delivered to the outside location by the so-called "fill-before-fire" manner in which the piezoelectric sheet can be deformed or curved with an electric voltage lower than an electric voltage with which a liquid is delivered in the so-called "fill-after-fire" manner. Therefore, the present apparatus can be operated with the use of low voltage and accordingly can be produced at still reduced cost.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
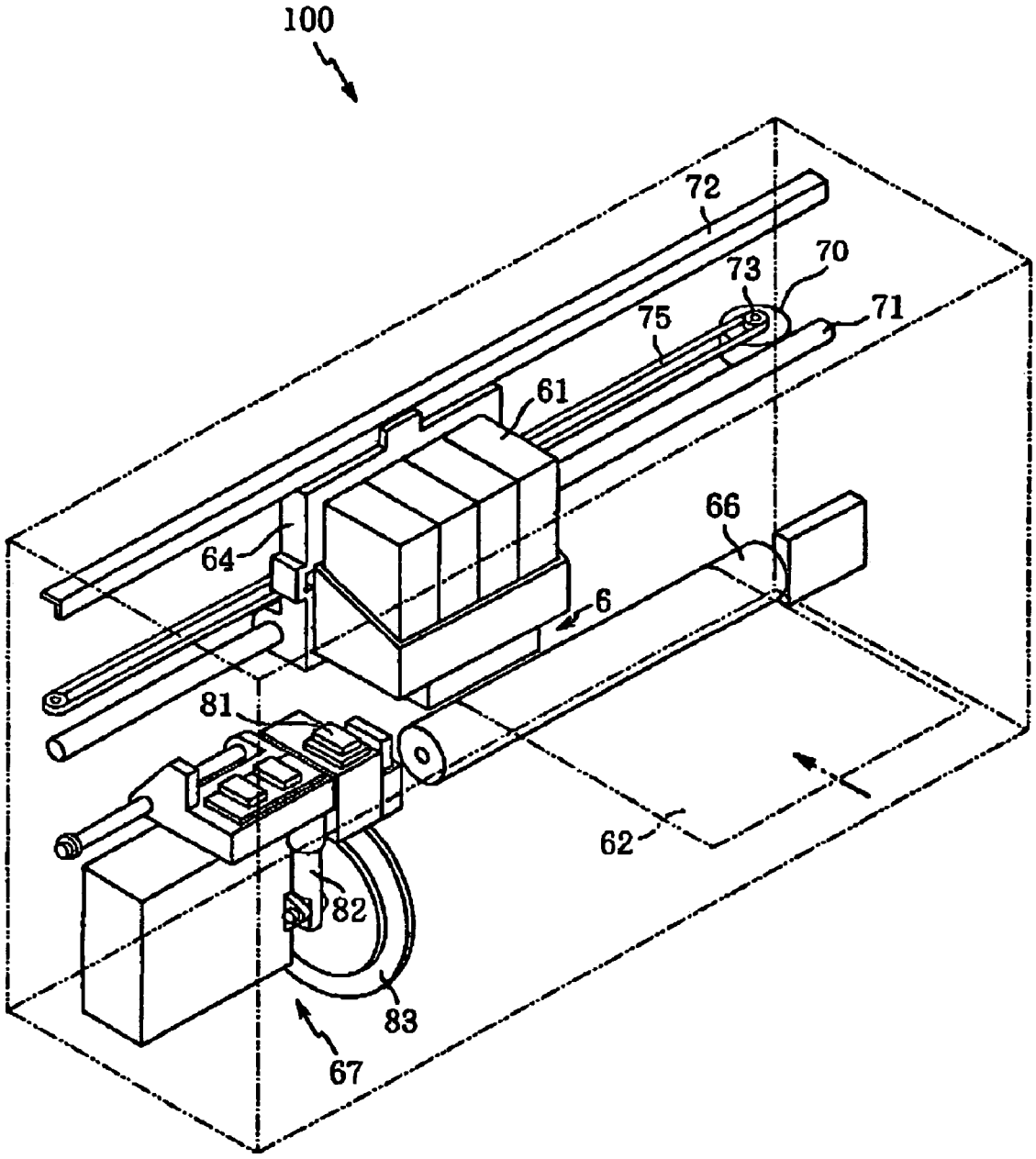
FIG. 1 is a perspective view of an ink jet recording apparatus employing a piezoelectric ink jet recording head to which the present invention is applied.

Hereinafter, there will be described a preferred embodiment of the present invention by reference to the drawings. FIG. 1 shows an ink jet recording apparatus 100 employing a piezoelectric ink jet recording head 6 in accordance with the present invention. First, the ink jet recording apparatus 100 is briefly described. The piezoelectric ink jet recording head 6 is for ejecting, from each of a plurality of ink ejection nozzles 54 (FIG. 3), a droplet of ink toward a sheet of paper 62 as a sort of recording medium, and thereby recording an image on the sheet of paper 62. The recording head 6 is mounted, together with ink cartridges 61, on a carriage 64, such that the recording head 6 faces downward. The recording head 6 will be described in detail, later.

The carriage 64 on which the ink jet recording head 6 is mounted is secured to an endless belt 75 and, when a pulley 73 is rotated forward and backward by an electric motor 70, the endless belt 75 is moved and accordingly the carriage 64 is linearly reciprocated while being guided by a shaft member 71 and a guide plate 72. While the carriage 64 is reciprocated, the ink ejection nozzles 54 of the recording head 6 eject respective droplets of ink toward the sheet of paper 62. The recording sheet 62 is fed from a sheet supplying cassette, not shown, to a gap provided between the recording head 6 and a platen roller 66 and, after the recording head 6 records the image on the recording sheet 62, the sheet 62 is discharged into a sheet collecting cassette, not shown. Sheet feeding and discharging devices are not shown in FIG. 1.

A purging device 67 is provided on one side of the platen roller 66. The purging device 67 is for removing bad ink occluding the nozzles 54 of the recording head 6. When the carriage 64 is positioned at a resetting position, a purging cap 81 covers a nozzle supporting surface of the recording head 6 so as to form a gas-tight space whose pressure is lowered by an electric pump 82 which communicates with the purging cap 81 and is operated by a cam 83. Thus, the bad ink occluding the nozzles 54 of the recording head 6 is removed by the purging device 67.

The ink jet recording apparatus 100 incorporates an electronic control circuit or device, not shown, which is essentially constituted by a microcomputer including a CPU (central processing unit), a ROM (read only memory), and a RAM (random access memory) and which controls, according to control programs pre-stored by the ROM, various operations of the recording apparatus 100, for example, an ink ejecting operation of the ink jet recording head 6 and a purging operation of the purging device 67.

Next, there will be described a construction of the piezoelectric ink jet recording head 6, by reference to FIGS. 2, 3, and 4A.

The ink jet recording head 6 includes a channel unit 10 having a plurality of liquid chambers 16 each of which opens upward; and a piezoelectric actuator 20 which is bonded, with an adhesive, to an upper surface of the channel unit 10, such that the piezoelectric actuator 20 closes respective upper, open ends of the liquid chambers 16 of the channel unit 10.

First, the channel unit 10 will be described below. As shown in FIG. 2, the channel unit 10 is constituted by a plurality of sheet members 11, 12, 13, 14 which are stacked on each other. Since the piezoelectric actuator 20, described later, has a plurality of individual electrodes 26 exposed in the lower surface thereof at least a cavity sheet 14 as an uppermost sheet or layer of the channel unit 10 is formed of an electrically insulating material, such as synthetic resin, glass, or ceramic material, so as to prevent occurrence of a short circuit between each of the individual electrodes 26 and the cavity sheet 14. In this case, the liquid chambers 16 are supplied with an electrically insulating ink from the ink cartridges 61. The electrically insulating ink may be replaced with an ink having a significantly high electrical resistance. The other sheet members 11, 12, 13 are each formed of an electrically conductive material, such as stainless steel or Fe—Ni alloy.

Figure 6A:
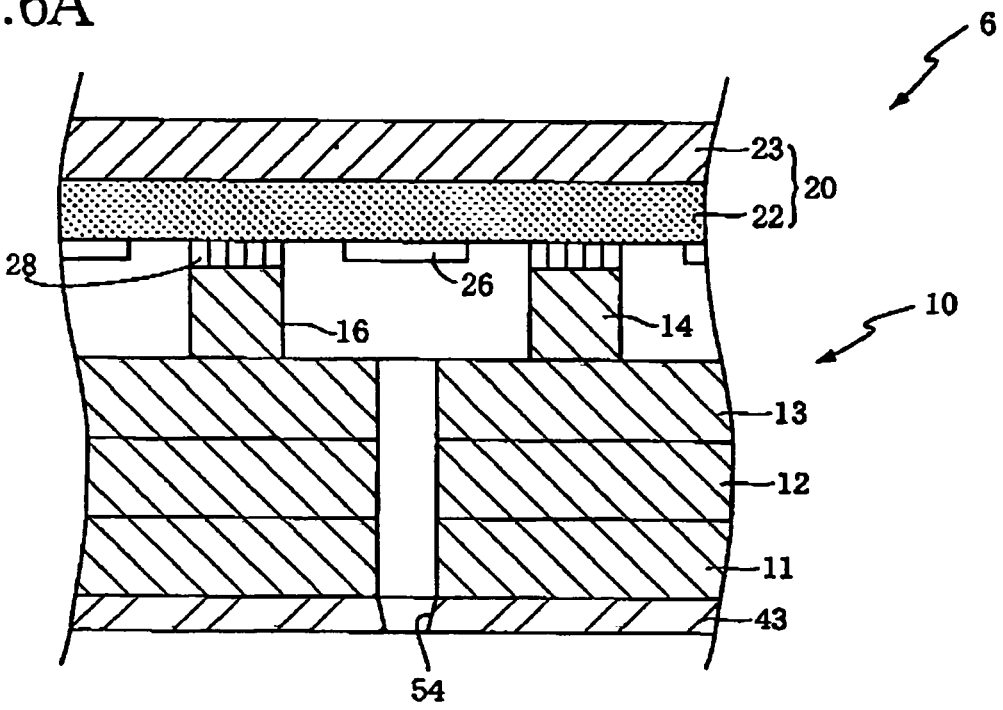
FIG. 6A is a cross-sectional view corresponding to FIG. 4A, showing another ink jet recording head as another embodiment of the present invention.
Figure 6B:
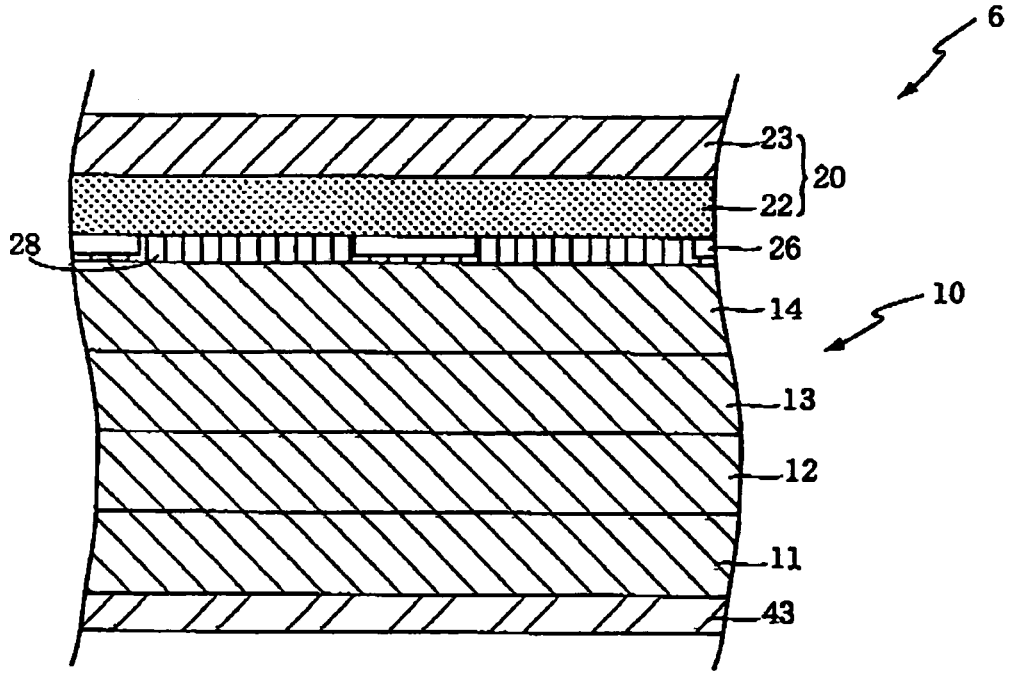
FIG. 6B is a cross-sectional view of the recording head of FIG. 6A, taken along 6B-6B in FIG. 2.

However, in a modified embodiment of the present invention, the cavity sheet 14 is formed of an electrically conductive material e.g., the same material as that used to form the other sheet members 11 through 13. In this case, as shown in FIGS. 6A and 6B, an electrically insulating layer 28 is interposed between each of the individual electrodes 26 and the cavity sheet 14. The insulating layer 28 is formed by, e.g., an aerosol deposition method in which fine particles of, e.g., silicon dioxide or alumina are sprayed at a high speed to, and deposited on, the upper surface of the cavity sheet 14 that is to be opposed to the piezoelectric actuator 20, so that each of the individual electrodes 26 is electrically insulated from the electrically conductive cavity sheet 14. In FIGS. 6A and 6*b*, the same reference numerals as used in the embodiment shown in FIG. 4A are used to designate the corresponding elements of the modified embodiment, and the description thereof is omitted.

Figure 3:
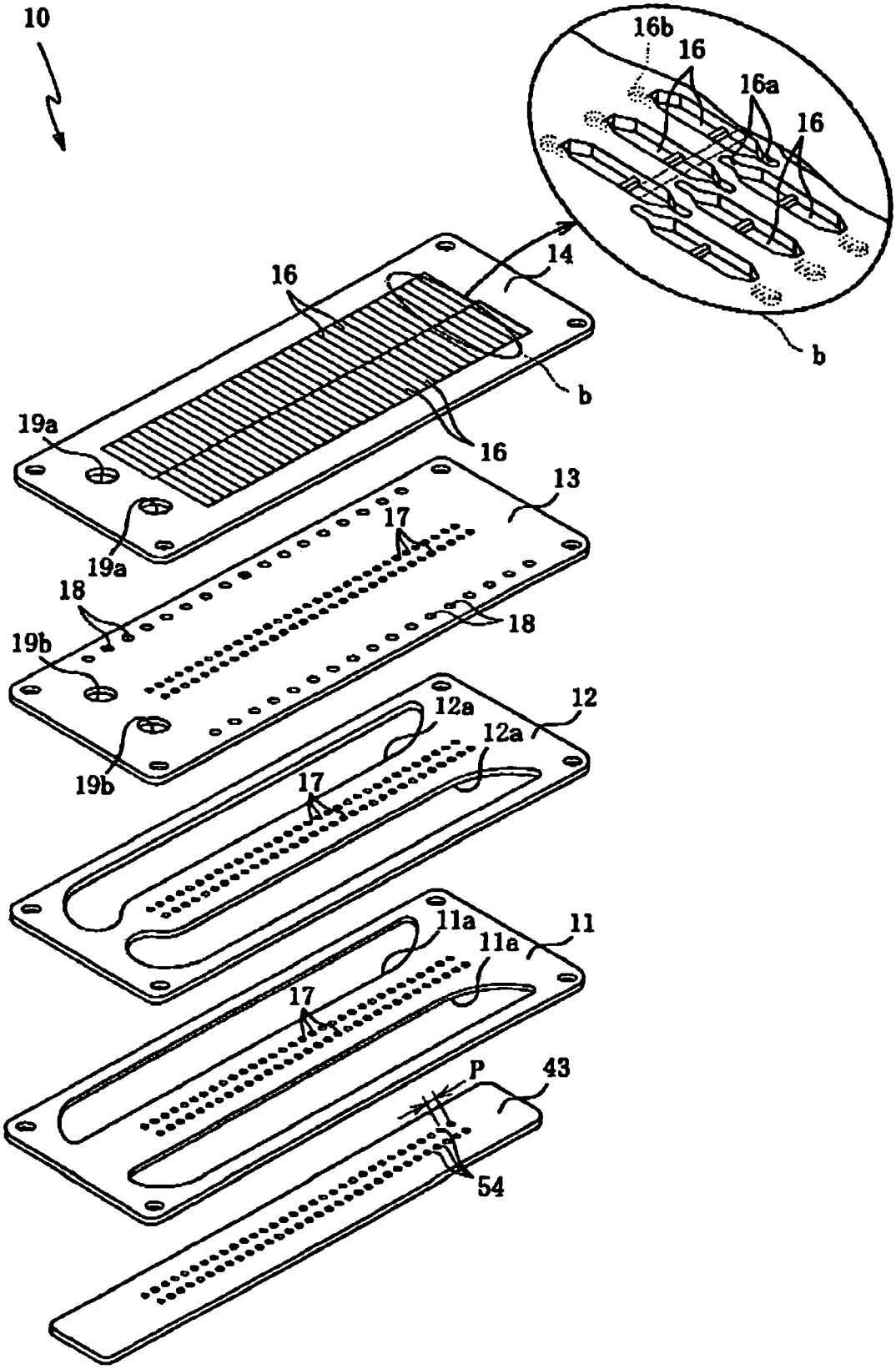
FIG. 3 is an exploded, perspective view of a channel unit of the recording head.

As shown in FIG. 3, the channel unit 10 includes four sheet members, i.e., two manifold sheets 11, 12, a spacer sheet 13, and the cavity sheet 14 which are stacked on each other, and additionally includes a nozzle sheet 43 which is adhered to the stacked sheet members 11 through 14. In the present embodiment, each of the sheet members 11, 12, 13, 14, 43 has a thickness ranging from about 50 μm to about 150 μm.

The nozzle sheet 43 is constituted by a sheet member formed of a synthetic resin, and provides a lowermost sheet or layer of the channel unit 10. The nozzle sheet 43 has the plurality of ink ejection nozzles 54 each of which has a small diameter and which are arranged in two arrays in a staggered or zigzag pattern in a lengthwise direction (hereinafter referred to as the first direction, where appropriate) of the channel unit 10 or the recording head 6. In each array of nozzles 54, the nozzles 54 are arranged at a regular, small interval of distance, P, as shown in FIG. 3.

The upper manifold sheet 12 has, as part of a plurality of ink channels, two half manifold chambers 12*a*, 12*a* which are formed through a thickness of the sheet 12 such that the two half manifold chambers 12*a*, 12*a* extend along, and outside, the two arrays of ink ejection nozzles 54, respectively. Each of the two half manifold chambers 12*a* is aligned, in its plan view, with a corresponding one of two arrays of liquid chambers 16, described later, and extends along the one array of liquid chambers 16. The lower manifold sheet 11, provided below the upper manifold sheet 12, has, in an upper surface thereof, two half manifold chambers 11*a*, 11*a* which are aligned with the two half manifold chambers 12*a*, 12*a* of the upper manifold sheet 12, respectively, and which have, in their plan view, substantially the same shapes as those of the half manifold chambers 12*a*, 12*a*. The half manifold chambers 11*a* open in only the upper surface of the lower manifold sheet 11, and do not extend through a thickness of the same 11. When the two manifold sheets 11, 12 are bonded to each other, the two half manifold chambers 11*a*, 11*a* cooperate with the two half manifold chambers 12*a*, 12*a* to define two complete manifold chambers 11*a*, 12*a*; 11*a*, 12*a*.

The cavity sheet 14 is stacked on the upper manifold sheet 12 via the spacer sheet 13, and provides the uppermost layer of the channel unit 10. The cavity sheet 14 has a plurality of liquid chambers 16 which are arranged, along a centerline of the sheet 14, in two arrays in a zigzag manner in the lengthwise direction (i.e., the first direction) of the channel unit 10. In a state in which the four sheet members 11, 12, 13, 14 are stacked on each other, the liquid chambers 16 open upward in the upper surface of the cavity sheet 14 that is opposite from the spacer sheet 13.

The two arrays of liquid chambers 16 are provided on either side of the above-indicated centerline of the cavity sheet 14, respectively, The liquid chambers 16 of one array are alternate with the liquid chambers 16 of the other array in the lengthwise direction of the channel unit 10, and each of the liquid chambers 16 has an elongate shape extending in a widthwise direction (hereinafter, referred to as the second direction, where appropriate) of the channel unit 10 that is perpendicular to the lengthwise direction (i.e., the first direction) of the unit 10 and the centerline of the cavity sheet 14.

An inner end portion 16*a* of each of the liquid chambers 16 communicates with a corresponding one of the ink ejection nozzles 54 of the nozzle sheet 43 via corresponding small-diameter through-holes 17 which are formed through respective thickness of the spacer sheet 13 and the two manifold sheets 11, 12. An outer end portion 16*b* of the each liquid chamber 16 communicates with a corresponding one of the two complete manifold chambers 11*a*, 12*a*; 11*a*, 12*a* of the manifold sheets 11, 12 via a small-diameter through-hole 18 which is formed through a thickness of a corresponding one of widthwise opposite end portions of the spacer sheet 13. As shown in an enlarged view indicated by "b" in FIG. 3, the outer end portion 16*b* of each liquid chamber 16 opens in only a lower surface of the cavity sheet 14.

The cavity sheet 14 has, in one of lengthwise opposite end portions thereof two supply holes 19*a*, 19*a*, and the spacer sheet 13 has, in a corresponding one of lengthwise opposite end portions thereof two supply holes 19*b*, 19*b* which are aligned with the two supply holes 19*a*, 19*a*, respectively. The two supply holes 19*a* and the two supply holes 19*b* communicate with the two manifold chambers 11*a*, 12*a*; 11*a*, 12*a*, respectively. The ink supply holes 19*a*, 19*a* of the cavity sheet 14 are covered with a filter, not shown, which removes foreign matters from the ink supplied from the ink cartridges 61.

Thus, the ink supplied from the ink cartridges 61 flows into the two manifold chambers 11*a*, 12*a*; 11*a*, 12*a* via the ink supply holes 19*a*, 19*b*, and then the ink is supplied from the manifold chambers 11*a*, 12*a* to each of the liquid chambers 16 via a corresponding one of the through-holes 18. Finally, the ink is delivered from each of the liquid chambers 16 to a corresponding one of the ink ejection nozzles 54 via the corresponding through-holes 17 of the spacer sheet 13 and the manifold sheets 11, 12, as shown in FIG. 4A.

Next, the piezoelectric actuator 20 that is to be stacked on the above-described channel unit 10 will be described by reference to FIGS. 2 and 4A. The piezoelectric actuator 20 is deformed relative to each of the liquid chambers 16 of the channel unit 10 so as to change a volume of the each liquid chamber. The piezoelectric actuator 20 has a two-layer structure including a piezoelectric sheet 22 located on the side of the channel unit 10, and an elastic restrictor sheet 23 opposite from the unit 10. The piezoelectric sheet 22 and the restrictor sheet 23 have a substantially same size, and have a width greater than that of the channel unit 10. As indicated by two-dot chain lines in FIG. 2, the piezoelectric actuator 20 is stacked on the channel unit 10, such that widthwise opposite end portions of the actuator 20 project in lateral directions from widthwise opposite end portions of the unit 10.

The piezoelectric sheet 22 constitutes a piezoelectric element which can elastically deform the restrictor sheet 23, and is opposed to all the liquid chambers 16 of the channel unit 10. Since the piezoelectric sheet 22 is common to all the liquid chambers 16, it is not needed to provide a plurality of individual piezoelectric elements which are opposed to the liquid chambers 16, respectively. Thus, the piezoelectric sheet 22 enjoys its simple structure.

The piezoelectric sheet 22 is essentially formed of lead zirconate titanate that is a solid solution of lead titanate and lead zirconate and is also a ferroelectric substance. The smaller the thickness of the piezoelectric sheet 22 is, the lower the drive voltage needed to drive the sheet 22 can be, but then the smaller the amount of deformation of the sheet 22 is. Accordingly, the rigidity of the restrictor sheet 23, i.e., the thickness of the same 23 needs to be decreased. The restrictor sheet 23 is formed of an elastic material.

In the present embodiment, the restrictor sheet 23 is formed to have a very small thickness of about 30 μm, and the piezoelectric layer 22 is formed to have a thickness of several microns (μm), e.g., about 10 μm. The piezoelectric sheet 22 whose thickness ranges from several microns (μm) to about 10 μm is formed by an aerosol deposition method or a sol-gel method. In the aerosol deposition method, fine particles of a piezoelectric material used to form the piezoelectric sheet 22 are sprayed, at a high speed, toward a surface of the restrictor sheet 23 and are deposited on the sheet 23.

On an opposite surface of the piezoelectric layer 20 that is remote from the restrictor sheet 23 and is opposed to the liquid chambers 16 of the channel unit 10, there are provided a plurality of individual electrodes 26 which are aligned with the liquid chambers 16, respectively. Thus, the individual electrodes 26 are arranged, along two widthwise opposite ends of the piezoelectric sheet 22, in two arrays in a zigzag fashion in the first direction (i.e., the lengthwise direction) of the recording head 6, as shown in an enlarged view indicated by "a" in FIG. 2.

Figure 2:
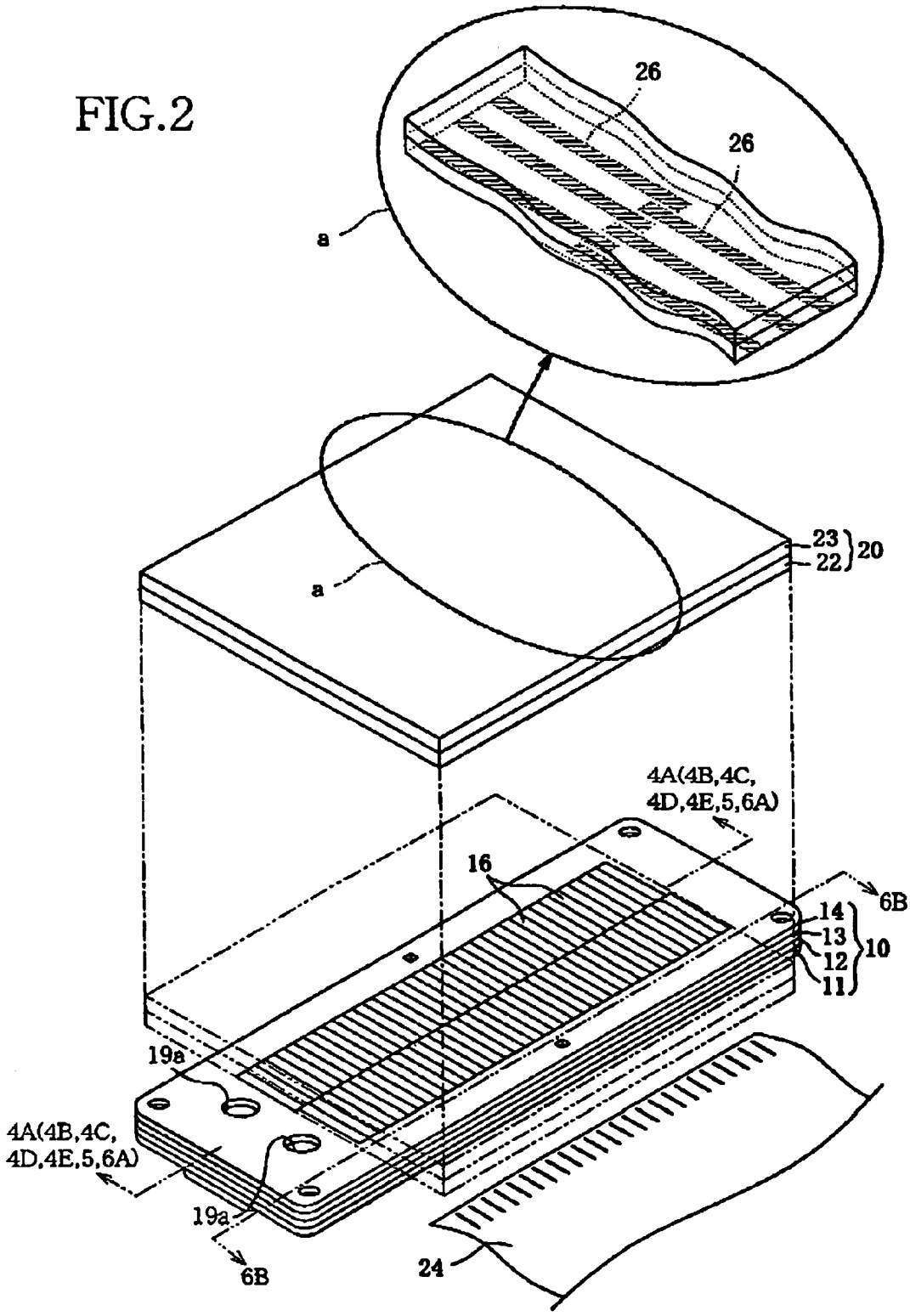
FIG. 2 is an exploded, perspective view of the piezoelectric ink jet recording head.

Each of the individual electrodes 26 has a strip-like shape, and extends, in the second direction perpendicular to the first direction, from a widthwise central portion of the piezoelectric sheet 22 to a corresponding one of the widthwise opposite ends of the same 22 where a portion of the each individual electrode 26 is exposed, in a corresponding one of widthwise opposite side surfaces of the recording head 6, so as to be electrically connected to a wiring pattern of a corresponding one of two flexible wiring substrates 24 (only one substrate 24 is shown in FIG. 2). Thus, each of the individual electrodes 26 is supplied with a positive voltage from the control device of the recording apparatus 100.

Figure 4A:
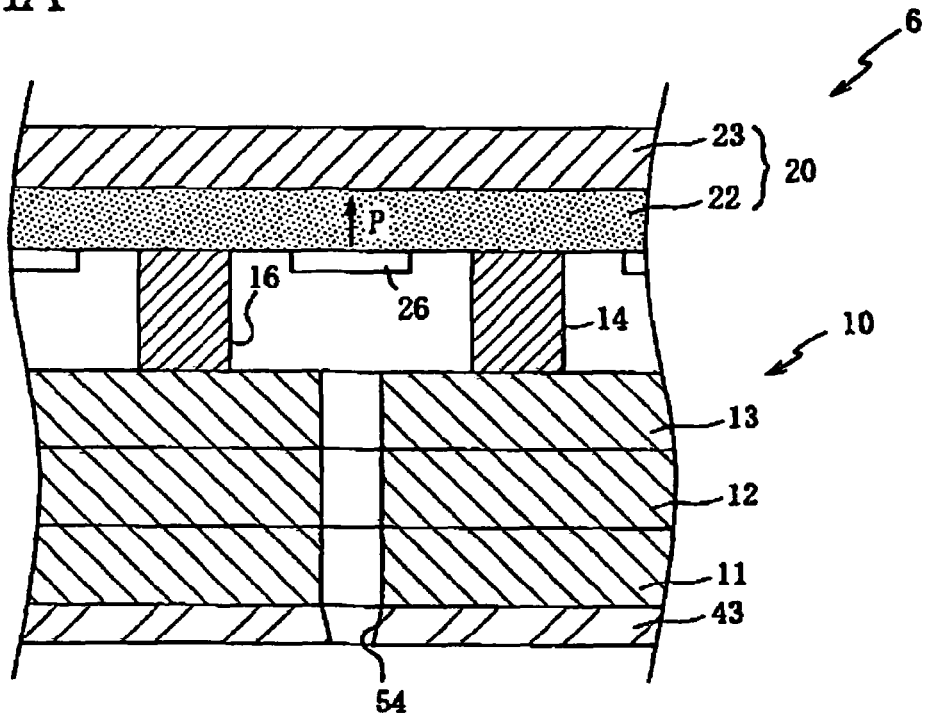
FIG. 4A is a cross-sectional view of the recording head, taken along 4A-4A in FIG. 2, in a state in which an electric voltage is not applied to a piezoelectric sheet of the recording head.

As shown in FIG. 4A, each of the individual electrodes 26 has a width in its plan view that is smaller than a width of each of the liquid chambers 16, and is located in its plan view in a substantially central portion of a corresponding one of the liquid chambers 16.

Since the piezoelectric sheet 22 is a ferroelectric, the piezoelectric sheet 22 can be polarized in one direction, when a high voltage is applied thereto, and this polarization remains after the application of the voltage is stopped. In the present embodiment, the piezoelectric sheet 22 is polarized, in advance, in a direction, indicated by "P" in FIG. 4A, from each of the individual electrodes 26 toward the restrictor sheet 23, when an electric voltage that is higher than a drive voltage used to operate the piezoelectric actuator 20 is applied to the individual electrodes 26 and the restrictor sheet 23.

The restrictor sheet 23 not only restricts deformation of each of a plurality of active portions of the piezoelectric sheet 22, but also functions as a common or second electrode which cooperates with each of the individual electrodes 26 as the first electrodes to apply an electric voltage to a corresponding one of the active portions of the piezoelectric sheet 22. The restrictor sheet 23 is stacked on the surface of the piezoelectric sheet 22 that is remote from the individual electrodes 26, and is constituted by an electrically conductive sheet member formed of, e.g., stainless steel. In the state in which the piezoelectric actuator 20 including the restrictor sheet 23 is stacked on the channel unit 10, widthwise opposite end portions of the restrictor sheet 23 project laterally from the channel unit 10, and are electrically connected to wiring patterns of the flexible wiring substrates 24.

In the embodiment shown in FIG. 4A, the drive voltage is applied to an arbitrary one of the individual electrodes 26 and the restrictor sheet 23, such that the arbitrary individual electrode 26 has a higher electric potential and the restrictor sheet 23 has a lower electric potential, i.e., an electric field is produced in the same direction as the direction in which the piezoelectric sheet 22 is polarized. Th this end, the arbitrary individual electrode 26 may have a positive electric potential while the restrictor sheet 23 may be grounded; the arbitrary individual electrode 26 may have a positive electric potential while the restrictor sheet 23 may have a negative electric potential; or alternatively the arbitrary individual electrode 26 may be grounded while the restrictor sheet 23 may have a negative electric potential.

Figure 4B:
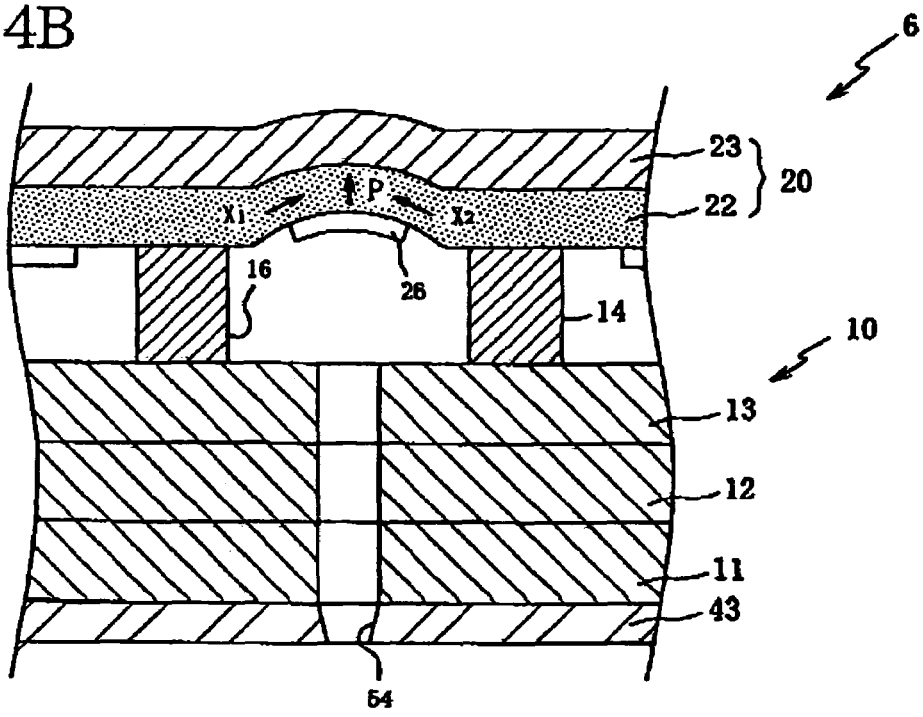
FIG. 4B is a cross-sectional view corresponding to FIG. 4A, in a state in which the electric voltage is applied to the piezoelectric sheet of the recording head.
Figure 4C:
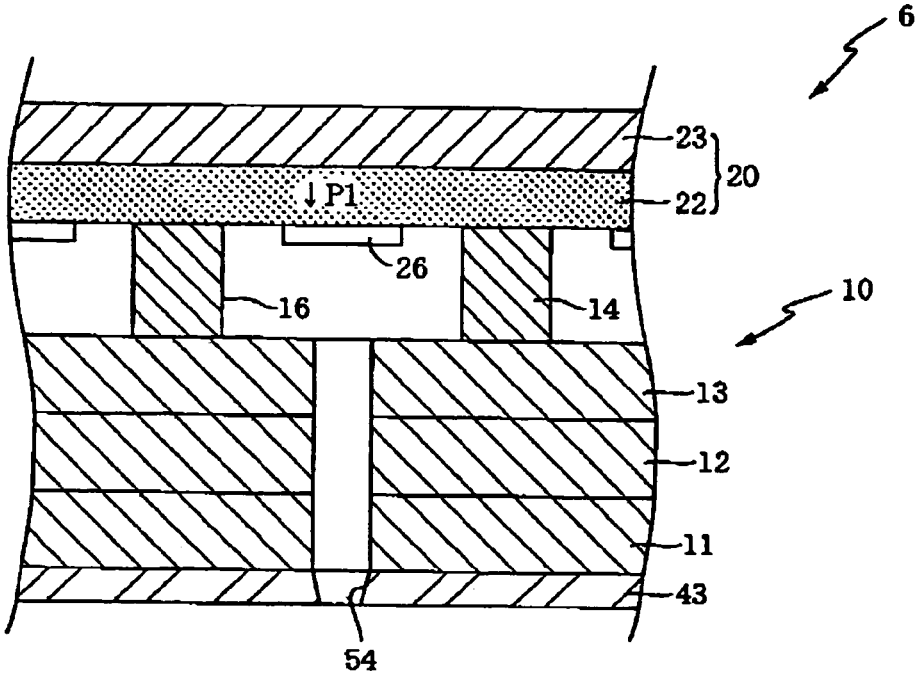
FIG. 4C is a cross-sectional view corresponding to FIG. 4A, showing another ink jet recording head as a modified embodiment of the present invention.

However, in a modified embodiment shown in FIG. 4C, the piezoelectric sheet 22 is polarized in a direction, indicated by "P1", from the restrictor sheet 23 toward each of the individual electrodes 26. In this case, the drive voltage is applied to an arbitrary one of the individual electrodes 26 and the restrictor sheet 23, such that the restrictor sheet 23 has a higher electric potential and the arbitrary individual electrode 26 has a lower electric potential, i.e., an electric field is produced in the same direction as the direction in which the piezoelectric sheet 22 is polarized. To this end, the arbitrary individual electrode 26 may have a negative electric potential while the restrictor sheet 23 may be grounded; the arbitrary individual electrode 26 may have a negative electric potential while the restrictor sheet 23 may have a positive electric potential; or alternatively the arbitrary individual electrode 26 may be grounded while the restrictor sheet 23 may have a positive electric potential.

Figure 4D:
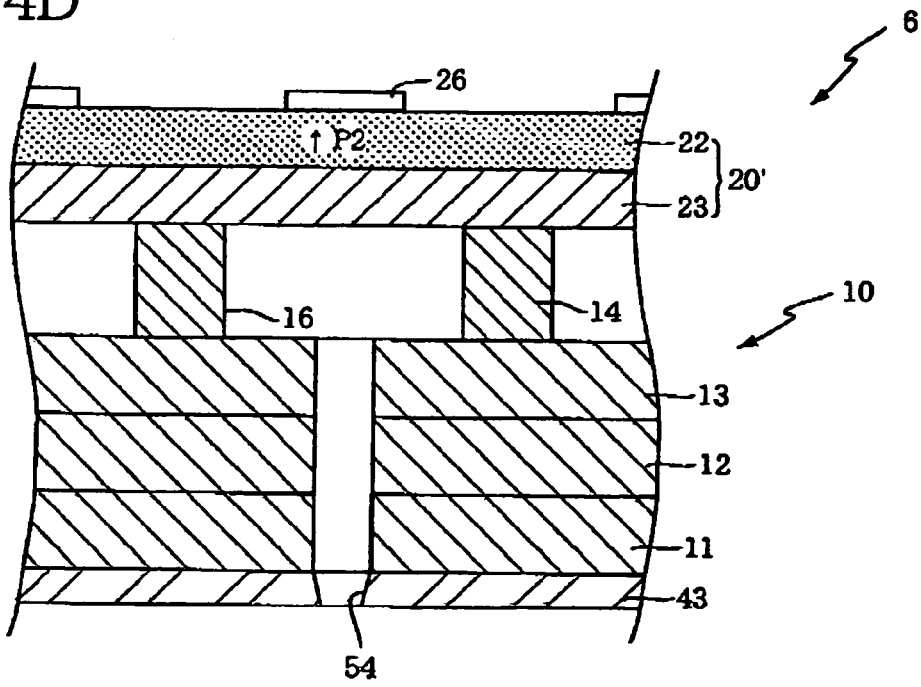
FIG. 4D is a cross-sectional view corresponding to FIG. 4A, showing another ink jet recording head as another modified embodiment of the present invention.

In another modified embodiment shown in FIG. 4D, the piezoelectric sheet 22 and the restrictor sheet 23 of the piezoelectric actuator 20 are stacked, upside down, on the channel unit 10, and the individual electrodes 26 are provided on an upper or outer surface of the piezoelectric sheet 22 that is remoter from the liquid chambers 16 than the restrictor sheet 23. In this case, the piezoelectric sheet 22 is polarized in a direction, indicated by "P2", from the restrictor sheet 23 toward each of the individual electrodes 26, and the drive voltage is applied to an arbitrary one of the individual electrodes 26 and the restrictor sheet 23, such that the arbitrary individual electrode 26 has a higher electric potential and the restrictor sheet 23 has a lower electric potential, i.e., an electric field is produced in a direction opposite to the direction in which the piezoelectric sheet 22 is polarized. To this end, the arbitrary individual electrode 26 may have a positive electric potential while the restrictor sheet 23 may be grounded; the arbitrary individual electrode 26 may have a positive electric potential while the restrictor sheet 23 may have a negative electric potential; or alternatively the arbitrary individual electrode 26 may be grounded while the restrictor sheet 23 may have a negative electric potential.

Figure 4E:
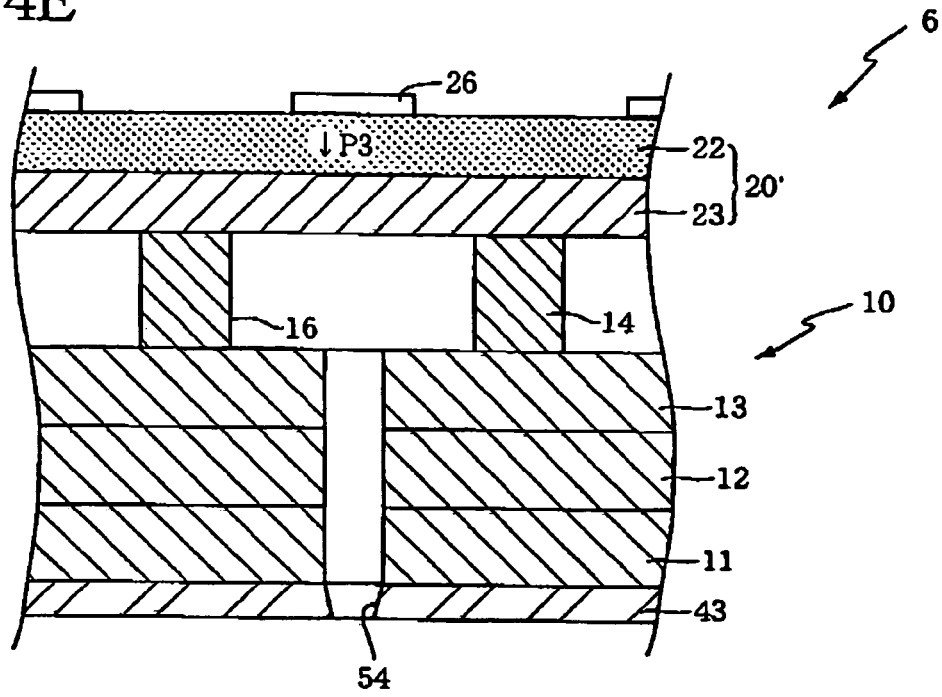
FIG. 4E is a cross-sectional view corresponding to FIG. 4A, showing another ink jet recording head as another modified embodiment of the present invention.

In yet another modified embodiment shown in FIG. 4E, the piezoelectric sheet 22 and the restrictor sheet 23 of the piezoelectric actuator 20 are stacked, upside down, on the channel unit 10, and the individual electrodes 26 are provided on an upper or outer surface of the piezoelectric sheet 22 that is remote from the liquid chambers 16, like in the modified embodiment shown in FIG. 4D. In this case, however, the piezoelectric sheet 22 is polarized in a direction, indicated by "P3", from each of the individual electrodes 26 toward the restrictor sheet 23, and the drive voltage is applied to an arbitrary one of the individual electrodes 26 and the restrictor sheet 23, such that the restrictor sheet 23 has a higher electric potential and the arbitrary individual electrode 26 has a lower electric potential, i.e., an electric field is produced in a direction opposite to the direction in which the piezoelectric sheet 22 is polarized. To this end, the arbitrary individual electrode 26 may have a negative electric potential while the restrictor sheet 23 may be grounded; the arbitrary individual electrode 26 may have a negative electric potential while the restrictor sheet 23 may have a positive electric potential; or alternatively the arbitrary individual electrode 26 may be grounded while the restrictor sheet 23 may have a positive electric potential.

Next, there will be described an ink ejecting operation of the piezoelectric ink jet recording head 6 constructed as descried above, by reference to FIGS. 4A and 4B that are cross-sectional views taken along 4A(4B)-4A(4B) in FIG. 2. FIG. 4A shows a state in which no electric voltage is applied to any of the individual electrodes 26, and the restrictor sheet 23; and FIG. 4B shows a state in which an electric voltage is applied to an arbitrary one of the individual electrodes 26, and the restrictor sheet 23.

When a positive voltage is applied by a drive circuit, not shown, to an arbitrary one of the individual electrodes 26, and the restrictor sheet 23 is grounded, an electric field is produced in a corresponding one of the active portions of the piezoelectric sheet 22 that is sandwiched by the one individual electrode 26 and the restrictor sheet 23, in the same direction as the direction of polarization P, more specifically described, a direction from the one individual electrode 26 toward the restrictor sheet 23. Consequently the corresponding active portion of the piezoelectric sheet 22 is shrunk in directions indicated by "X1", "X2" that are substantially perpendicular to the polarization direction P. Since this shrinkage of the corresponding active portion of the piezoelectric sheet 22 is restricted by a corresponding portion of the restrictor sheet 23, the corresponding active portion of the piezoelectric sheet 22 and the corresponding portion of the restrictor sheet 23 are deformed or curved in a direction away from the corresponding liquid chamber 16, as shown in FIG. 4B.

Thus, a volume of the liquid chamber 16 corresponding to the individual electrode 26 to which the positive voltage is applied, is increased, and a pressure of the ink accommodated by the liquid chamber 16 is lowered. Preferably, after a pressure wave produced by the increasing of volume of the liquid chamber 16 has traveled over a one-way distance in the lengthwise direction of the chamber 16, that is, at a timing when the pressure of the ink in the liquid chamber 16 turns positive, the piezoelectric actuator 20 returns to its initial state shown in FIG. 4A, so that a pressure is applied to the ink in the liquid chamber 16. Thus, a droplet of ink is ejected from the ink ejection nozzle 54 communicating with the liquid chamber 16, in the so-called "fill-before-fire" manner.

In the "fill-before-fire" manner, the ink can be efficiently ejected from the liquid chamber 16, by utilizing the change of pressure of the ink in the liquid chamber 16. Therefore, in the "fill-before-fire" manner, the piezoelectric sheet 22 can be driven or operated with the lower electric voltage than that used in the so-called "fill-after-fire" manner.

In each of the three modified embodiments shown in FIGS. 4C, 4D, and 4E, a droplet of ink is ejected from each of the liquid chambers 16, in the same manner as described above with respect to the embodiment shown in FIGS. 4A and 4B.

Figure 5:
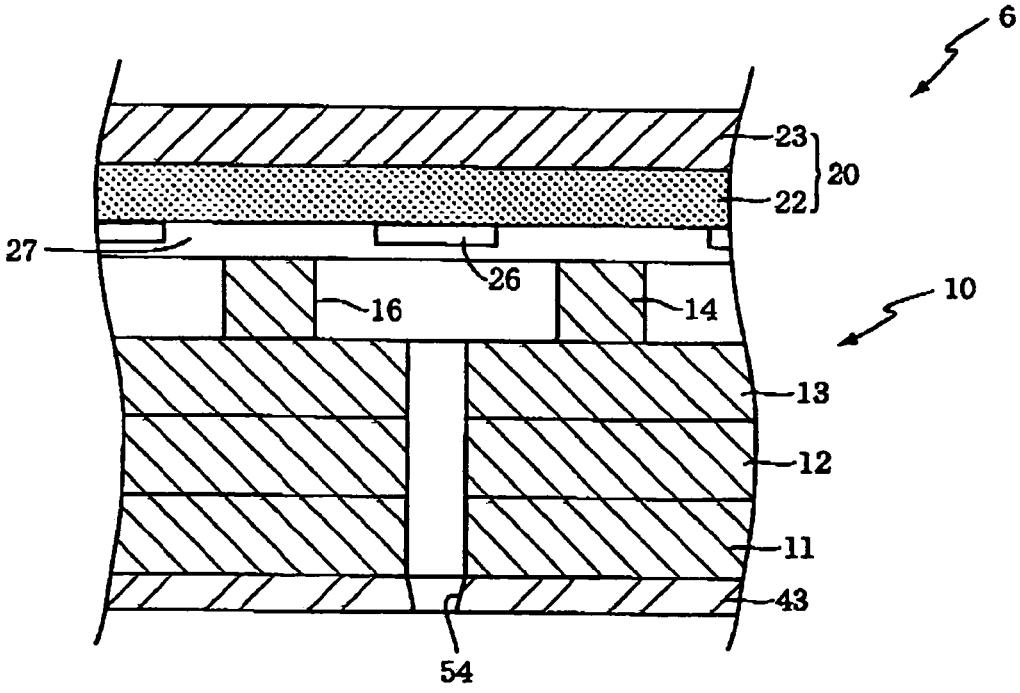
FIG. 5 is an enlarged, illustrative cross-sectional view of another piezoelectric ink jet recording head as another embodiment of the present invention.

FIG. 5 shows another embodiment of the present invention in which an electrically insulating, protective layer 27 is formed on the lower surface of the piezoelectric sheet 22 that is opposed to the liquid chambers 16 of the channel unit 10, such that the protective layer 27 covers the individual electrodes 26 and thereby electrically insulates the same 26 from the ink. In the second embodiment shown in FIG. 5, the same reference numerals as used in the first embodiment shown in FIGS. 4A and 4B are used to designate the corresponding elements of the second embodiment, and the description of those elements is omitted. The protective layer 27 is formed on the entire surface of the piezoelectric sheet 22, located on the side of the liquid chambers 16, in an aero deposition method in which fine particles of, e.g., silicon dioxide or alumina are sprayed at a high speed to the surface of the sheet 22 and are deposited on that surface. Since the protective layer 7 covers the individual electrodes 26, the individual electrodes 26 are prevented from contacting the ink in the liquid chambers 16 and are protected against rusting and corrosion. In this embodiment, the ink may be an electrically conductive one.

In each of the illustrated embodiments shown in FIGS. 1 through 3 and 4A through 4C, the cavity sheet 14 has a plurality of openings which are formed through the thickness thereof and which define the liquid chambers 16, respectively, and the piezoelectric sheet 22 is provided on one of the opposite major surfaces of the cavity sheet 14 so as to close the openings of the cavity sheet 14. Therefore, when the piezoelectric sheet 22 is deformed, the pressure of the ink in the liquid chamber 16 is changed to deliver the ink from the liquid chamber 16. In addition, the ink jet recording head 6 can enjoy a small thickness.

In each of the illustrated embodiments shown in FIGS. 1 through 3, 4A through 4E, 5, and 6A and 6B, each of the individual electrodes 26 is opposed to a substantially central portion of a corresponding one of the liquid chambers 16. Thus, the active portion of the piezoelectric sheet 22 that is opposed to the one liquid chamber 16 can be efficiently deformed, and accordingly the ink can be stably delivered to an outside location.

In each of the illustrated embodiments shown in FIGS. 1 through 3, 4A through 4E, 5, and 6A and 6B, the piezoelectric sheet 22 is formed by depositing the fine particles as the material of the piezoelectric sheet 22, on one of the opposite major surfaces of the restrictor sheet 23. Thus, even if the restrictor sheet 23 may be considerably thin, the piezoelectric sheet 22 having an appropriate thickness can be formed on the restrictor sheet 23. Therefore, when the piezoelectric sheet 22 is driven or operated with a low electric voltage, the piezoelectric sheet 22 can be largely deformed. Thus, the ink jet recording head 6 can be run at reduced cost.

In the illustrated embodiment shown in FIG. 5, the ink jet recording head 6 includes the protective layer 27 which is provided on one of the opposite major surfaces of the piezoelectric sheet 22, so as to cover the individual electrodes 26 provided on the one major surface of the piezoelectric sheet 23. The protective layer 27 is formed by depositing the fine particles as the material of the protective layer, on the one major surface of the piezoelectric sheet 22, so as to cover the individual electrodes 26. Thus, the individual electrodes 26 can be protected against rusting or corrosion. In addition, the thin protective layer 27 can be easily formed.

Each of the above-described embodiments relates to the ink jet recording head 6 of the ink jet recording apparatus 100. However, the present invention is applicable to various sorts of liquid delivering apparatuses each of which delivers a liquid by applying, to the liquid, a pressure produced by deformation of a piezoelectric element, e.g., a piezoelectric sheet.

It is to be understood that the present invention may be embodied with various changes and improvements that may occur to a person skilled in the art, without departing from the spirit and scope of the invention defined in the appended claims.

What is claimed is:

1. A liquid delivering apparatus, comprising:

a unimorph-deformation piezoelectric actuator including:

a piezoelectric sheet which is opposed to a plurality of liquid chambers for accommodating a liquid and which is polarized in a direction of thickness thereof;

a restrictor sheet which is opposed to the liquid chambers, which restricts a deformation of the piezoelectric sheet, and which functions as a first electrode; and a plurality of second electrodes which are opposed, via a plurality of active portions of the piezoelectric sheet, to a plurality of restrictive portions of the restrictor sheet, respectively, and are opposed to the liquid chambers, respectively, wherein when an arbitrary one of the active portions of the piezoelectric sheet is deformed by an electric field which is generated in a direction substantially parallel to the direction of polarization of the piezoelectric sheet, the arbitrary one of the active portions of the piezoelectric sheet and a corresponding one of the restrictive portions of the restrictor sheet are curved in a direction to increase a volume of a corresponding one of the liquid chambers.

2. The liquid delivering apparatus according to claim 1, wherein the direction of polarization of the piezoelectric sheet is directed from one of the restrictor sheet and each of the second electrodes toward an other of the restrictor sheet and said each second electrode, and the direction of the electric field is the same as the direction of polarization, and wherein the restrictor sheet is remoter from the liquid chambers than the piezoelectric sheet and the second electrodes.

3. The liquid delivering apparatus according to claim 2, wherein the direction of polarization of the piezoelectric sheet is directed from said each second electrode toward the restrictor sheet, and the direction of the electric field is directed from said each second electrode which has a higher electric potential, toward the restrictor sheet which has a lower electric potential.

4. The liquid delivering apparatus according to claim 3, wherein the direction of the electric field is directed from said each second electrode which has a positive electric potential, toward the restrictor sheet which is grounded.

5. The liquid delivering apparatus according to claim 3, wherein the direction of the electric field is directed from said each second electrode which has a positive electric potential, toward the restrictor sheet which has a negative electric potential.

6. The liquid delivering apparatus according to claim 3, wherein the direction of the electric field is directed from said each second electrode which is grounded, toward the restrictor sheet which has a negative electric potential.

7. The liquid delivering apparatus according to claim 2, wherein the direction of polarization of the piezoelectric sheet is directed from the restrictor sheet toward said each second electrode, and the direction of the electric field is directed from the restrictor sheet which has a higher electric potential, toward said each second electrode which has a lower electric potential.

8. The liquid delivering apparatus according to claim 7, wherein the direction of the electric field is directed from the restrictor sheet which is grounded, toward said each second electrode which has a negative electric potential.

9. The liquid delivering apparatus according to claim 7, wherein the direction of the electric field is directed from the restrictor sheet which has a positive electric potential, toward said each second electrode which has a negative electric potential.

10. The liquid delivering apparatus according to claim 7, wherein the direction of the electric field is directed from the restrictor sheet which has a positive electric potential, toward said each second electrode which is grounded.

11. The liquid delivering apparatus according to claim 1, wherein the direction of polarization of the piezoelectric sheet is directed from one of the restrictor sheet and each of the second electrodes, toward an other of the restrictor sheet and said each second electrode, and the direction of the electric field is opposite to the direction of polarization of the piezoelectric sheet, and wherein the second electrodes are remoter from the liquid chambers than the piezoelectric sheet and the restrictor sheet.

12. The liquid delivering apparatus according to claim 11, wherein the direction of polarization of the piezoelectric sheet is directed from the restrictor sheet toward said each second electrode, and the direction of the electric field is directed from said each second electrode which has a higher electric potential, toward the restrictor sheet which has a lower electric potential.

13. The liquid delivering apparatus according to claim 12, wherein the direction of the electric field is directed from said each second electrode which has a positive electric potential, toward the restrictor sheet which is grounded.

14. The liquid delivering apparatus according to claim 12, wherein the direction of the electric field is directed from said each second electrode which has a positive electric potential, toward the restrictor sheet which has a negative electric potential.

15. The liquid delivering apparatus according to claim 12, wherein the direction of the electric field is directed from said each second electrode which is grounded, toward the restrictor sheet which has a negative electric potential.

16. The liquid delivering apparatus according to claim 11, wherein the direction of polarization of the piezoelectric sheet is directed from said each second electrode toward the restrictor sheet, and the direction of the electric field is directed from the restrictor sheet which has a higher electric potential, toward said each second electrode which has a lower electric potential.

17. The liquid delivering apparatus according to claim 16, wherein the direction of the electric field is directed from the restrictor sheet which is grounded, toward said each second electrode which has a negative electric potential.

18. The liquid delivering apparatus according to claim 16, wherein the direction of the electric field is directed from the restrictor sheet which has a positive electric potential, toward said each second electrode which has a negative electric potential.

19. The liquid delivering apparatus according to claim 16, wherein the direction of the electric field is directed from the restrictor sheet which has a positive electric potential, toward said each second electrode which is grounded.

20. The liquid delivering apparatus according to claim 1, further comprising a sheet member having a plurality of openings which are formed through a thickness thereof and which define the liquid chambers, respectively, wherein the piezoelectric sheet is provided on one of opposite major surfaces of the sheet member so as to close the openings of the sheet member.

21. The liquid delivering apparatus according to claim 1, wherein each of the second electrodes is opposed to a substantially central portion of a corresponding one of the liquid chambers.

22. The liquid delivering apparatus according to claim 1, wherein the piezoelectric sheet is formed by depositing fine particles as a material of the piezoelectric sheet, on one of opposite major surfaces of the restrictor sheet.

23. The liquid delivering apparatus according to claim 1, further comprising a protective layer which is provided on one of opposite major surfaces of the piezoelectric sheet, so as to cover the second electrodes provided on said one major surface of the piezoelectric sheet.

24. The liquid delivering apparatus according to claim 23, wherein the protective layer is formed by depositing fine particles as a material of the protective layer, on said one major surface of the piezoelectric sheet, so as to cover the second electrodes.

25. The liquid delivering apparatus according to claim 1, wherein the liquid chambers accommodate an ink, and the liquid delivering apparatus comprises an ink jet recording apparatus having a plurality of ink ejection nozzles which communicate with the liquid chambers, respectively, and each of which ejects a droplet of the ink.

26. The liquid delivering apparatus according to claim 1, wherein the restrictor sheet opposed to the liquid chambers and functioning as the first electrode is constituted by a single, electrically conductive layer which is uniformly formed of a single sort of material.

27. The liquid delivering apparatus according to claim 26, wherein the single electrically conductive layer is formed of a single metallic sheet.

28. The liquid delivering apparatus according to claim 26, wherein the single electrically conductive layer has a first thickness greater than a second thickness of the piezoelectric sheet.

29. A liquid delivering apparatus, comprising:

a unimorph-deformation piezoelectric actuator including:

a piezoelectric sheet which is opposed to a plurality of liquid chambers for accommodating a liquid and which is polarized in a direction of thickness thereof;

a common electrode which is opposed to the liquid chambers and which functions as a restrictor sheet that restricts a deformation of the piezoelectric sheet, wherein the common electrode is constituted by a single, electrically conductive layer which is uniformly formed of a single sort of material and which has a first thickness greater than a second thickness of the piezoelectric sheet; and a plurality of individual electrodes which are opposed, via a plurality of active portions of the piezoelectric sheet, to a plurality of restrictive portions of the restrictor sheet, respectively, and are opposed to the liquid chambers, respectively, wherein when an arbitrary one of the active portions of the piezoelectric sheet is deformed by an electric field which is generated in a direction substantially parallel to the direction of polarization of the piezoelectric sheet, the arbitrary one of the active portions of the piezoelectric sheet and a corresponding one of the restrictive portions of the restrictor sheet are curved in a direction to increase a volume of a corresponding one of the liquid chambers.

30. A liquid delivering apparatus, comprising:

a unimorph-deformation piezoelectric actuator consisting of:

a piezoelectric sheet which is opposed to a plurality of liquid chambers for accommodating a liquid and which is polarized in a direction of thickness thereof;

a common electrode which is opposed to the liquid chambers and which functions as a restrictor sheet that restricts a deformation of the piezoelectric sheet, wherein the common electrode is constituted by a single, electrically conductive layer which is uniformly formed of a single sort of material and which has a first thickness greater than a second thickness of the piezoelectric sheet; and a plurality of individual electrodes which are opposed, via a plurality of active portions of the piezoelectric sheet, to a plurality of restrictive portions of the restrictor sheet, respectively, and are opposed to the liquid chambers, respectively, wherein when an arbitrary one of the active portions of the piezoelectric sheet is deformed by an electric field which is generated in a direction substantially parallel to the direction of polarization of the piezoelectric sheet, the arbitrary one of the active portions of the piezoelectric sheet and a corresponding one of the restrictive portions of the restrictor sheet are curved in a direction to increase a volume of a corresponding one of the liquid chambers.

* * * * *